United States Patent [19]

Palzer

[11] 4,055,384

[45] Oct. 25, 1977

[54] ROOFING APPARATUS

[76] Inventor: Augustine M. Palzer, 3919 - 52nd Ave. North, Brooklyn Center, Minn. 55429

[21] Appl. No.: 729,378

[22] Filed: Oct. 4, 1976

[51] Int. Cl.[2] ..... A46B 11/00; A46B 17/02

[52] U.S. Cl. ..... 401/48; 401/193; 401/268; 156/578

[58] Field of Search ..... 401/48, 56, 9, 13, 137, 401/193, 286, 268, 290; 118/207, 305; 156/578

[56] References Cited

U.S. PATENT DOCUMENTS

| | | | |
|---|---|---|---|
| 2,847,689 | 8/1958 | Miller | 401/48 |
| 3,099,582 | 7/1963 | Ongstad et al. | 401/48 |
| 3,135,430 | 6/1964 | Caldwell | 401/48 X |
| 3,155,544 | 11/1964 | McConnel et al. | 401/9 X |
| 3,173,166 | 3/1965 | Christensen | 401/48 X |

*Primary Examiner*—Stephen C. Pellegrino
*Attorney, Agent, or Firm*—Robert C. Baker

[57] ABSTRACT

The portable apparatus for cementing edges of lengths of sheet material in adherent relationship over a roof comprises a horizontally oriented base structure having contact means at its lower surface for applying pressure upon the sheet material. The base structure has one substantially straight lateral side which is located adjacent and parallel to an imaginary vertical plane. The apparatus includes a brush member for applying cementing fluid underneath an edge of sheet material. The bristles of the brush member are at an angle of between about 90° and 140° with respect to the main body of the ferrule in which the heel end of the bristles are retained. A ferrule holder holds the main body of the ferrule of the brush member in vertical orientation next to the aforenoted imaginary vertical plane at a location forwardly beyond the leading edge of the base structure, with the bristles of the brush member extending away from the imaginary vertical plane. A nozzle feeds cementing fluid within the angular configuration of the brush member at the heel end of the bristles thereof. The base structure is free of any element which projects laterally outward therefrom beyond the imaginary vertical plane at any location along the one substantially straight lateral side of the base structure. The combination renders the apparatus effective for sealing even the edges of sheet material located adjacent to an upstanding wall.

8 Claims, 5 Drawing Figures

ROOFING APPARATUS

This invention relates to a portable apparatus for cementing edges of lengths of sheet material in adherent relationship over a roof or any equivalent substrate.

The apparatus of this invention is especially useful for cementing the edges of lengths of sheet material or roofing to an underlying flat substrate along edges of the roof or substrate next to an upstanding wall. It is also useful for cementing or sealing overlapping edges of sheet material together at any location on a roof or equivalent substrate.

Apparatus for sealing, seaming or marking sheets or substrates has heretofore been available; and the following U.S. patents are illustrative: Signor U.S. Pat. No. Re. 18,449; Terry U.S. Pat. No. 1,234,233; Porter et al U.S. Pat. No. 1,491,625; Ongstad et al U.S. Pat. No. 3,099,582; Caldwell U.S. Pat. No. 3,135,430; Glade U.S. Pat. No. 3,280,710; Taylor U.S. Pat. No. 3,374,049.

None of the aforenoted prior art patents teach any apparatus in any way related to that of this invention. The most similar apparatus heretofore known is that known as a "Trocal Jet" and made available by a West German company called Dynamit Nobel Aktiengesellschaft. But the apparatus of that West German company lacks the critical features of the apparatus hereof and is useless for sealing the edges of sheeting at locations next to a perimeter upstanding wall about a flat roof. Such operations have heretofore, insofar as is known, been necessarily accomplished by hand. Thus, one of the major benefits of this invention is that of introducing convenience and a saving of time and labor in accomplishing edge seals or cementing next to an upstanding wall. Several novel features and structural relationships are critical to the end of providing apparatus suitable for such operations.

The portable apparatus of this invention comprises a horizontally oriented base structure having contact means at its lower surface for applying pressure upon or over sheet material. The base structure has one substantially straight lateral side and a leading edge and a trailing edge. The apparatus also includes brush member for applying cementing fluid underneath an edge of sheet material, bracket means anchored on the base structure for holding the brush member forwardly beyond the leading edge of the base structure, a nozzle for discharging cementing fluid onto the brush member, conduit means for conveying cementing fluid to the nozzle, and handle means for guiding the apparatus in movement along an edge of sheet material. Further, this apparatus is particularly or additionally characterized in that:

a. Its brush member consists essentially of a substantially flat layer of bristles held at their heel end by a substantially flattened ferrule having an angular section at the portion thereof adjacent the heel end of the bristles. The angular section of the ferrule is at an angle with respect to the main body of the ferrule so that the flat layer of bristles projects laterally away from one lateral side of the main body. The angular configuration between the main body and the bristles of the brush member is between about 90° and 140°.

b. Its bracket means comprises a ferrule holder for holding the main body of the flattened ferrule in vertical orientation at a location substantially parallel and adjacent to an imaginary vertical plane defined as a vertical plane which extends parallel and adjacent to the one substantially straight lateral side of the base structure. The main body of the flattened ferrule is held in the ferrule holder with the bristles of the brush member extending from the lower end and extending laterally from the main body in a direction away from the aforesaid imaginary vertical plane and on the same side thereof as the base structure.

c. Its nozzle is mounted on the apparatus for discharge of the cementing fluid within the angular configuration of the brush member at the heel end of the bristles thereof.

d. And its base structure is free of any element which projects laterally outward therefrom beyond the aforesaid imaginary vertical plane at any location along the one substantially straight lateral side of the base structure. Thus, the combination of structural features renders the apparatus effective for sealing even the edges of sheet material located adjacent to an upstanding wall.

Additional features and various advantages or benefits for the same will be evident from the following description, made by reference to a drawing, made a part hereof, wherein.

Figure 1:
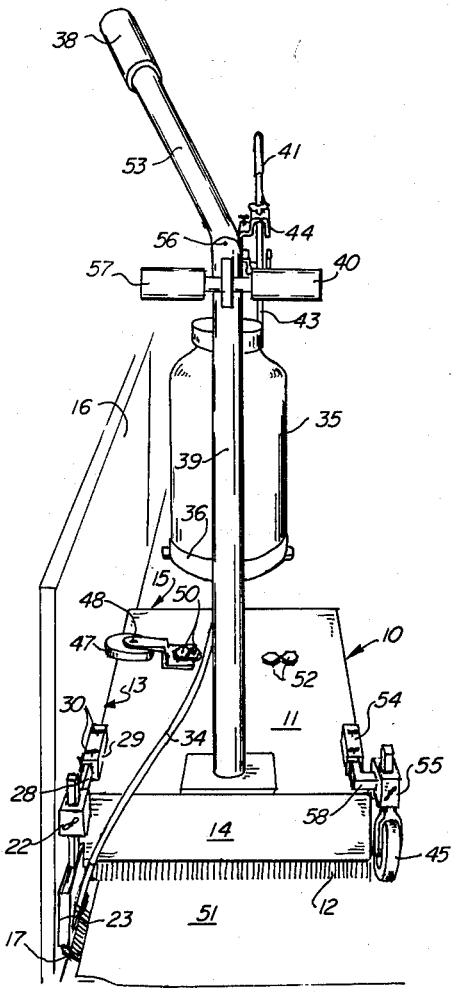
FIG. 1 is a schematic front (or leading edge) perspective view of the apparatus, with the apparatus shown illustratively in operation for cementing the edge of sheet material next to an upstanding wall.

In describing the apparatus of this invention with the aid of the drawing, reference will sometimes be made to an imaginary vertical plane. This is necessary to explain clearly the relationships and features of the invention which make it outstanding for use in sealing even the edges of flat roof sheeting next to an upstanding perimeter wall or other upstanding structure.

The apparatus comprises a base structure suitably having a rectangular box-like overall shape 10. The base structure includes a box-like frame or body 11 and has contact means 12 at its lower surface for applying pressure upon sheet material to be sealed to an underlying substrate or layer. Illustratively, relatively short bristles of the scrub brush variety may project downwardly and serve as the contact means. Scrub brushes or other contact elements are held in position by any suitable frame elements within body 11. The weight of the base structure may be adjusted up or down so as to provide desired sealing pressure on sheeting over which the contact means on the underside of the base structure is moved. Generally, the frame 11 is formed of sheet metal of whatever weight one might desire. Additional pressure for sealing is suitably applied by an operator applying some of his own weight on the apparatus.

To be recognized is the fact that the base structure 10 is horizontally oriented; that is, it extends over a horizontal area of some reasonable size such as, for example, a few square feet or a half square meter. The base structure has one substantially straight lateral side 13, plus a leading edge 14 and a trailing edge 15 located in spaced relationship to each other. With respect to an imaginary vertical plane, illustrated in FIG. 1 by wall 16, the leading edge 14 and trailing edge 15 are in spaced relationship with respect to their locations next to that imaginary vertical plane. Further, the one substantially straight lateral side 13 of the base structure is specified, for purposes of description, as being located parallel to and adjacent to that imaginary vertical plane. Thus it is that the horizontally oriented base structure 10 is adjacent to and extends laterally outwardly from only one side of the imaginary vertical plane illustrated by wall 16.

A critical part of the apparatus is the special brush applicator assembly 17 and the details of the location and the relationships for it at its position forwardly beyond the leading edge 14 of the base structure 10. This assembly is located substantially adjacent to the aforenoted imaginary vertical plane extending along one side of the base structure. All elements of the applicator assembly lie on the same side of the imaginary vertical plane as the base structure.

Figure 3:
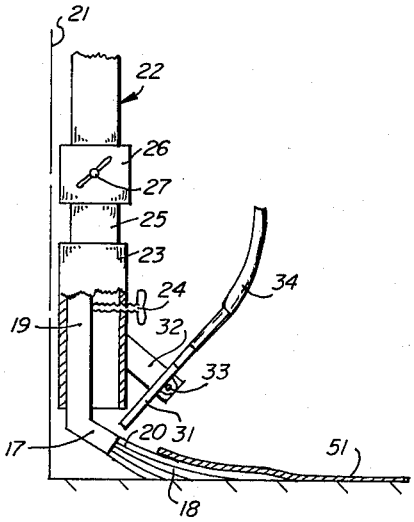
FIG. 3 is an enlarged schematic front elevational view, partially broken away, of the brush member, ferrule holder, nozzle and associated bracket portions of the apparatus of FIG. 1.
Figure 4:
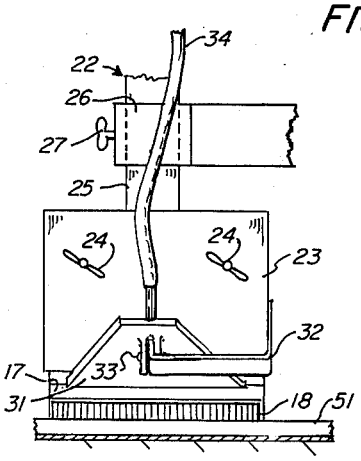
FIG. 4 is an enlarged schematic side elevational view of the same elements as in FIG. 3.

The brush member of the applicator assembly is especially critical in design. It has a substantially flat layer of bristles 18 or hairs or the like (herein repeatedly called "bristles", whether synthetic or natural). These bristles 18 are best shown in FIG. 3. They are relatively long and characteristically of a length common for paint brushes. They are held as a flat layer by a substantially flattened ferrule 19. However, the ferrule 19 is not simply that which has heretofore commonly been known. The ferrule structure of this invention is one having an angular section at the portion thereof adjacent the heel end 20 of the bristles 18. The angular section is identified by the numeral 17 in the drawing. It is a bent portion of the ferrule 19. The angular section is at an angle with respect to the main body (identified by numeral 19 in FIG. 3) of the ferrule structure so that the bristles 18 of the brush member project laterally outward from only one lateral side of the flattened main body 19 of the ferrule. The angular configuration between the main body 19 of the flattened ferrule and the projecting bristles 18 is between about 90° and 140°, and usually between about 100° and 130°.

The brush member (i.e., bristles 18 and ferrule 19) of the applicator assembly is mounted forwardly of the leading edge 14 of the base structure 10 by any suitable bracket means 22 carried by the base structure 10. This bracket means, however, must be such as to extend forwardly from the leading edge of the base frame. It includes a ferrule holder 23 for holding the flattened main body 19 of the ferrule in a vertical orientation at a location substantially adjacent to and in parallel relationship with the imaginary vertical plane. That plane is illustrated as a wall 16 in FIG. 1 and by a dash line 21 in FIG. 3. The imaginary vertical plane is suitably defined as a vertical plane extending parallel and adjacent to the one substantially straight lateral side 13 of the base structure 10.

To be stressed is the relationship of bristles 18 with respect to the flattened main body 19 of the ferrule when the ferrule is held in the aforenoted vertical orientation and parallel relationship with the imaginary vertical plane. Bristles 18 extend from the lower bent or angular end 17 of the ferrule; and they extend laterally from the main body 19 of the ferrule in a direction away from the imaginary vertical plane of number 16 in FIG. 1 and numeral 21 in FIG. 3. Thus, they project away from the main body 19 of the ferrule and in a direction more or less parallel with the leading edge 14 of a rectangular base structure 10.

The ferrule holder 23 suitably consists of an inverted flattened container-like shape, and is equipped with winged set screws or any equivalent fastening means 24 to fixedly hold the main body 19 of the ferrule therewithin.

Because the bristles 18 of the brush structure of the applicator have a tendency to wear during use, and because they also tend to change in their angular relationship to the main body 19 of the flattened ferrule during extensive use (i.e., with the angular relationship gradually shifting toward a 90° angular relationship during use), it is extremely desirable to mount the main body 19 of the ferrule in a manner so that adjustments may be made in terms of moving the brush member up or down as well as in terms of increasing or decreasing the degree to which the brush member is positioned beyond the leading edge 14 of the base structure. Thus the bracket means 22 for holding the brush member of the applicator assembly preferably includes means for making such adjustments. Illustratively, the ferrule holder 23 is fixedly mounted in depending relationship at the end of a square or other non-circular shaft 25 which fits in vertically adjustable fashion within a cooperating collar or bushing 26. The bushing 26 is equipped with a winged set screw 27 or the like for securing shaft 25 against movement with respect to it. Bushing 26 is fixedly mounted at the end of a horizontally extending arm or shaft 28 which suitably is square or at least preferably non-circular in cross section. Shaft 28 is mounted for horizontal slidable movement within a cooperating collar or bushing 29 which in turn is fixed on the base structure 10 at a location near the substantially straight lateral side 13. Set screws 30 are for securing shaft 28 against shifting movement. The illustrated arrangement permits adjustment of the distance the brush applicator assembly projects forwardly of the base structure and the relative height of the ferrule holder 23 above a roof substrate.

A fanned nozzle 31 is mounted on the apparatus for discharge of cementing fluid within the angular configuration of the brush member at the heel end 20 of the bristles 18. The cementing fluid may simply consist of a solvent for softening the sheeting to gain adherence, or it may comprise an adhesive, if desired. Preferably, the fanned nozzle 31 is mounted on a bracket 32 which is fixed on the ferrule holder 23. Bracket 32 may include means 33 for adjustment of the angularity of the nozzle 31 as it empties into the bent or angular portion 17 of the ferrule near the heel end 20 of the bristles. However, the fanned nozzle should be arranged at all times so that the elongated portion of the nozzle drops the fluid for cementing action into the angular configuration portion of the brush member. Cementing fluid flows from the heel part 20 of the bristles toward the outer tips of the bristles. This flow is facilitated by capillary action between bristles. The cementing fluid also moves to the upper and lower surfaces of the horizontally extending bristles for applying a coating of the same on the under surface of an edge of sheeting and on the underlying substrate.

Any suitable conduit 34 is used for conveying the cementing fluid to the fanned nozzle; and the conduit is carried by the base structure in any suitable manner. In the illustrated embodiment, a bottle 35, or any other vessel or reservoir for a quantity of cementing fluid, is shown as being carried by the base structure on any suitable holder 36 for it. However, if desired, the conduit feed to the fanned nozzle 31 might be accomplished from a separate or even a stationary reservoir of cementing fluid.

A valve 37 in or associated with the conduit means is employed for adjusting and controlling and opening and stopping the flow of cementing fluid through the conduit means to the fanned nozzle.

Any suitable means may be employed to facilitate opening and closing and adjustment of the valve 37 for the cementing fluid. Illustratively, a conveniently reached lever 41 pivotally mounted at a bracket 42 on frame element or tube 39 may be used to raise and lower a valve control arm 43 and thereby effect valve control or adjustment. If desired, any suitable mechanism 44 may be included on the apparatus for locking the valve control lever at any desired location during operation or storage.

An especially notable feature of this apparatus is the fact that the base structure, and even the apparatus in its entirety, is free of any element which projects laterally outward therefrom beyond the imaginary vertical plane at any location along the one substantially straight lateral side 13 of the base structure. This is critical for the edge sealing adjacent an upstanding wall. Of course, where the upstanding wall is very low, some upper part of the apparatus may project beyond the imaginary plane over the wall; but it is unnecessary for any part of the apparatus to so project.

Figure 2:
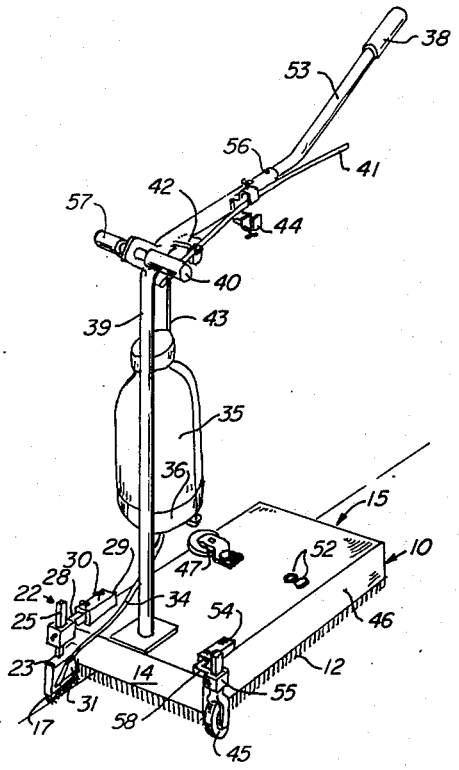
FIG. 2 is a further schematic perspective view of the apparatus of FIG. 1, taken at angle different from the view in FIG. 1.
Figure 5:
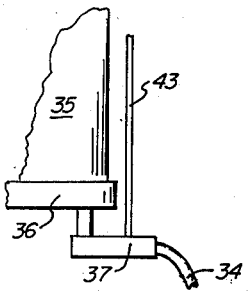
FIG. 5 is a schematic side elevational view of the apparatus of FIG. 1, with most parts broken away, showing a location for valve means in the conduit for cementing fluid.

In FIGS. 1 and 2 of the drawing, a wheel member 45 on a horizontal axis is shown near the leading edge 14 of the base frame, but at a location opposite the side of the base structure adjacent the aforenoted imaginary vertical plane. This single wheel 45 is useful as a support wheel for rolling the apparatus around to different locations as well as for moving the apparatus in a straight line along a wall member (or even in a open roof area where two lengths of overlapping sheet material are to be sealed together using the apparatus). Suitably, this support wheel member 45 may be adjustable in height as well as in its relative location along the side 46 of the base structure; and to that end, wheel 45 may be mounted on a bracket assembly formed of elements quite comparable to the elements 25 through 30, inclusive, for the ferrule holder 23. For example, wheel 45 may be mounted on the end of a vertical shaft adjustable within a collar or bushing 55. Bushing 55 is carried at the bent end of a horizontal arm 58 which is adjustable within a bushing or collar 54 mounted on the main frame 11. Note that the mounting of the bushing or collar 54 on main frame 11 is along the edge of the top of the main frame opposite the location for the collar 29; but both collars or holders 29 and 54 are similarly located on the main frame 11 but on opposite sides thereof.

Thus, the possibility exists to reverse the elements comprising the wheel assembly 45 and the ferrule holder assembly 23 from one side of the apparatus to the other. Specifically, the entire assembly for each of those elements may be removed from the fixed bushings or collars 29 and 54, respectively. Then, in the case of the removed wheel assembly, the vertical shaft carrying wheel 45 is removed from collar 55 and re-inserted into the opposite side of collar 55 so that, when the bent horizontal shaft 58 is turned upside down and inserted into fixed collar 29 (on the opposite side of the base 11), wheel 45 assumes the position on the opposite side of the base frame 11 which in all respects is the mirror image of the position illustrated in FIGS. 1 and 2.

The shifting of the ferrule holder assembly 23 to the opposite side of base frame 11 likewise is accomplished after turning the ferrule holder 23 in collar 26 so as to cause the bristles 18 to project in the mirror image direction to that illustrated in FIGS. 1 and 2.

Thus, an advantageous feature of the illustrated apparatus is that its elements may be shifted or adjusted to adapt the apparatus for movement along an upstanding wall either at the right or the left of the apparatus. This is especially beneficial in that it permits comfortable movement of the apparatus by either right-handed or left-handed operators. Further, this versatility is helpful where roofing is laid under windy conditions and the preferred direction of movement for sealing the roofing may vary.

To be recognized is that the side of the apparatus which is herein called the "one substantially straight lateral side" can be shifted from the right side (as viewed by an operator at the tail end of the apparatus illustrated in FIGS. 1 and 2) to the left side. This is done by shifting the ferrule assembly 23 and wheel assembly 45 as aforenoted. It is much preferred to employ a rectangular base frame 11, as illustrated, so that the requirements for the "one substantially straight lateral side" are met regardless of which lateral side of the apparatus is next to an imaginary vertical plane or upstanding wall during movement. Movement of the apparatus is normally effected by an operator; but powered movement is an optional possibility.

A basic handle or gripping arrangement for an operator may comprise a handle member 38 at the tail end of a frame element consisting essentially of a tube member mounted on its other end on the base structure 10. Tube 39 projects upwardly from the base 10 and then curves rearwardly and extends suitably even beyond the rear or trailing end 15 of the apparatus, with handle 38 at its end. If desired, the tail end of the tube on which handle 38 is located may be removably attached to the main tube 39. For example, tube portion 53 near handle 38 may telescopically be fitted into the main tube 39 and fastened by a removable pin 56, as illustrated. Further, tube portion 53 may be laterally bent so as to place handle 38 at one lateral side or the other relative to a medial vertical plane through the upstanding and curved portion of main tube 39.

In FIGS. 1 and 2, the handle 38 and tail end tube portion 53 are shown as being laterally displaced toward the right side of the apparatus (as viewed by an operator standing back of the trailing end of the apparatus); but the showing is solely to illustrate the concept of lateral displacement for the handle and tail end tube portion 53. In practice, the lateral displacement of the handle 38 and tube portion 53 for apparatus having its elements otherwise arranged as in FIGS. 1 and 2 would be the reverse of that illustrated. Thus an operator desiring the "right" side of the apparatus (as illustrated in FIGS. 1 and 2) to be the side for movement along a wall would, in practice, remove pin 56 and turn tube portion 53 with handle 38 about 180° before replacing pin 56. In this manner handle 38 would be shifted to project toward the left side of the apparatus (as viewed by an operator standing back of the trailing end of the apparatus). As such, the operator would grip handle 38 with his right hand and handle member 40 with his left. He then would have a tendency, when moving the apparatus forward, to push it snugly against an upstanding wall such as wall 16. (Handle 57, is of course the counterpart of handle 40 and is used when the apparatus elements are arranged for an edge sealing operation along the lateral side of the apparatus opposite to that illustrated.)

Advantageously, the apparatus is suitably equipped with spacing means to prevent abrading contact of the one substantially straight lateral side 13 of the base structure against an upstanding wall when the apparatus is moved along immediately adjacent to such a wall. Suitable spacing means may comprise a roller 47 in the nature of a wheel mounted on a vertical axis shaft 48. Axis shaft 48 is carried by a bracket 49 which can be adjusted in position and secured against movement by means of fasteners or bolts 50 holding the bracket 49 on the base structure 10. Such a roller 47 can be fixed to project fractionally beyond the straight lateral side 13 so as to engage in rolling contact along an upstanding wall as the apparatus is moved adjacently therealong. When the ferrule holder assembly 23 and wheel assembly 45 are reversed so as to shift the "one substantially straight lateral side" of the apparatus to the opposite side from that illustrated, this spacing roller assembly 47 is shifted to the opposite side of the base structure 10 and fastened by bolts 52.

The side of the base structure 10 carrying the ferrule holder assembly 23 is not equipped with any true support wheel comparable to wheel 45. If any support wheel were to be used near the side carrying the ferrule holder, it would of necessity have to be recessed within the body of the base structure or forwardly of the base structure so as to avoid projecting outwardly into the aforenoted imaginary vertical plane. Such a recessed support wheel is undesirable and interferes with the proper laying and sealing of the edge of the sheet material which is treated with cementing fluid at that side of the apparatus as it is moved along. No support wheel at the trailing end of the apparatus is desired. At least the trailing edge must be free for application of downward pressures for sealing.

In use, the bristles 18 of the brush member are placed under the edge of a length of sheeting 51 to be cemented in place. Cementing fluid trickles through the bristles and coats both the underlying edge of sheet 51 and the underlying substrate as the apparatus is moved along. The coated edge then falls upon the underlying coated area of the substrate, after which pressure is applied on the edge by the contact means 12 of the base structure during movement of the apparatus. Contrary to previous experience, edge cementing next to an upstanding wall is easily accomplished by using the apparatus of this invention and no longer is a time consuming and hand-accomplished task.

That which is claimed is:

1. A portable apparatus for cementing edges of lengths of sheet material in adherent relationship over a roof, comprising a horizontally oriented base structure having contact means at its lower surface for applying pressure upon said sheet material, said base structure having one substantially straight lateral side and having a leading edge and a trailing edge, a brush member for applying cementing fluid underneath an edge of said sheet material, bracket means anchored on said base structure for holding said brush member forwardly beyond the leading edge of said base structure, a nozzle for discharging cementing fluid into said brush member, conduit means for conveying cementing fluid to said nozzle, and handle means for guiding said apparatus in movement along an edge of sheet material, said apparatus being additionally characterized in that:

a. said brush member consists essentially of a substantially flat layer of bristles held at their heel end by a substantially flattened ferrule having an angular section at the portion thereof adjacent said heel end of said bristles, said angular section of said ferrule being at an angle with respect to the main body of said ferrule so that said flat layer of bristles projects laterally away from one lateral side of said main body, the angular configuration between said main body and said bristles of said brush member being between about 90° and 104°, b. said bracket means comprises a ferrule holder for holding said main body of said flattened ferrule in vertical orientation at a location substantially parallel and adjacent to an imaginary vertical plane defined as a vertical plane which extends parallel and adjacent to said one substantially straight lateral side of said base structure, said main body of said flattened ferrule being held in said ferrule holder with said bristles of said brush member extending from the lower end and extending laterally from said main body in a direction away from said imaginary vertical plane on the same side thereof as said base structure, c. said nozzle is mounted on said apparatus for discharge of said cementing fluid within said angular configuration of said brush member at the heel end of the bristles thereof, and d. said base structure is free of any element which projects laterally outward therefrom beyond said imaginary vertical plane at any location along said one substantially straight lateral side of said base structure, whereby said combination of structural features renders said apparatus effective for sealing even the edges of sheet material located adjacent to an upstanding wall.

2. The apparatus of claim 1 additionally characterized in that said base structure is free of any support wheels on a horizontal axis at any location outwardly from said one substantially straight lateral side of said base structure.

3. The apparatus of claim 1 additionally comprising means for adjusting the distance between said ferrule holder and the leading edge of said base structure, and means for adjusting the height of said ferrule holder while maintaining said main body of said ferrule in said vertical orientation.

4. The apparatus of claim 1 additionally comprising spacing means to prevent abrading contact of said one substantially straight lateral side of said base structure against an upstanding wall as said apparatus is moved adjacent therealong.

5. The apparatus of claim 4 wherein said spacing means comprises a roller carried on a vertical axis and mounted on said base structure proximate to said one substantially straight lateral side thereof.

6. The apparatus of claim 4 additionally comprising means for adjustment of the spacing distance effected by said spacing means.

7. The apparatus of claim 1 wherein said nozzle has a fanned opening and is oriented with the length of said fanned opening parallel to said angular section of said flattened ferrule.

8. A portable apparatus for cementing edges of lengths of sheet material in adherent relationship over a roof, said apparatus being effective for sealing even the edges of sheet material located adjacent to an upstanding perimeter wall about a roof, and having the following structural features in locations with respect to an imaginary vertical plane as specified:

a. a horizontally oriented base structure having contact means at its lower surface for applying pressure upon said sheet material, said base structure being adjacent to and extending laterally outwardly from only one side of said imaginary vertical plane, said base structure having a leading edge and a trailing edge located in spaced relationship to each other at spaced locations along said imaginary vertical plane, b. an applicator assembly for applying cementing fluid underneath an edge of said sheet material, said applicator assembly being located forwardly beyond the leading edge of said base structure, with all elements of said applicator assembly lying on the same side of said imaginary vertical plane as said base structure, said applicator assembly comprising a brush member consisting essentially of a substantially flat layer of bristles held at their heel end by a substantially flattened ferrule having an angular section at the portion thereof adjacent said heel end of said bristles, said angular section of said ferrule being at an angle with respect to the main body of said ferrule so that said flat layer of bristles projects laterally away from one lateral side of said main body, the angular configuration between said main body and said bristles of said brush member being between about 90° and 140°, c. bracket means mounted on said base structure and extending forwardly beyond the leading edge thereof, said bracket means comprising a ferrule holder for holding said main body of said ferrule in vertical orientation at a location substantially parallel and adjacent to said imaginary vertical plane, said main body of said flattened ferrule being held in said ferrule holder with said bristles of said brush member extending from the lower end and extending laterally from said main body in a direction away from said imaginary vertical plane, d. a fanned nozzle mounted on said apparatus for discharge of cementing fluid within said angular configuration of said brush member, e. conduit means carried by said base structure for conveying cementing fluid to said fanned nozzle, f. valve means for controlling the flow of cementing fluid through said conduit means, and g. handle means mounted on said base structure for an operator to guide said base structure in movement in a direction substantially parallel and adjacent to said imaginary vertical plane, said apparatus being free of any element which projects laterally outward therefrom beyond said imaginary vertical plane at any location along the side thereof adjacent said imaginary vertical plane.

* * * * *

UNITED STATES PATENT AND TRADEMARK OFFICE

CERTIFICATE OF CORRECTION

PATENT NO. : 4,055,384

DATED : October 25, 1977

INVENTOR(S) : Augustine M. Palzer

It is certified that error appears in the above-identified patent and that said Letters Patent are hereby corrected as shown below:

Column 8, line 15 (Claim 1), "104°" should read --140°--.

Signed and Sealed this

*Twenty-first* Day of *February 1978*

[SEAL]

*Attest:*

RUTH C. MASON
*Attesting Officer*

LUTRELLE F. PARKER
*Acting Commissioner of Patents and Trademarks*